US006870322B1

(12) United States Patent
Mizukoshi et al.

(10) Patent No.: US 6,870,322 B1
(45) Date of Patent: Mar. 22, 2005

(54) ORGANIC EL DISPLAY DEVICE HAVING ADJUSTABLE OFFSET VOLTAGE

(75) Inventors: Seiichi Mizukoshi, Kanagawa (JP); Nobuyuki Mori, Saitama (JP); Kouichi Onomura, Kanagawa (JP)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/628,934

(22) Filed: Jul. 29, 2003

(30) Foreign Application Priority Data

Oct. 17, 2002 (JP) ..... 2002-303574

(51) Int. Cl.[7] ..... G09G 5/00
(52) U.S. Cl. ..... 315/169.1; 315/169.3; 345/76; 345/77
(58) Field of Search ..... 315/169.1, 169.2, 315/169.3; 345/76, 77, 78

(56) References Cited

U.S. PATENT DOCUMENTS 6,667,580 B2 * 12/2003 Kim et al. ..... 315/169.3
6,690,117 B2 * 2/2004 Komiya ..... 315/169.3

* cited by examiner

*Primary Examiner*—David Vu
(74) *Attorney, Agent, or Firm*—Raymond L. Owens

(57) ABSTRACT

An organic EL display device which individually controls the amount of current of organic EL elements, which are arranged in a matrix of pixels, according to an input image signal, comprising total current detection circuitry for detecting the total current flowing to all the organic EL elements arranged in the pixel matrix, offset voltage setting circuitry for determining an offset voltage to offset the input image signal so as to apply a voltage which causes the current to start flowing to the organic EL elements according to a black level of the input image signal, and offset voltage control circuitry for controlling the offset voltage, which is responsive to the offset voltage setting circuitry, according to the total current detected by the total current detection circuitry.

3 Claims, 5 Drawing Sheets

ORGANIC EL DISPLAY DEVICE HAVING ADJUSTABLE OFFSET VOLTAGE

FIELD OF THE INVENTION

The present invention relates to an organic EL display device which adjusts an offset voltage to the drive circuit of the organic EL element.

BACKGROUND OF THE INVENTION

Organic EL display devices have organic EL elements and are arranged as pixels in a matrix and display by individually controlling the emission of the organic EL elements of the respective pixels. Organic EL display devices include an active type and a passive type. The active type organic EL display device, has associated with each pixel, a pixel or drive circuit for controlling current through the corresponding organic EL element. Active matrix types of drives are better for performing high definition display.

FIG. 1 shows an example of the pixel circuit of the active type organic EL display device. A drive TFT 1 is a p-channel type having its source connected to a power supply PVdd and its drain connected to an anode of an organic EL element 2. A cathode of the organic EL element 2 is connected to a cathode power supply CV.

A gate of the drive TFT 1 is connected to a source of an n-channel type selection TFT 3. A drain of the selection transistor 3 is connected to a data line Data which extends in a vertical direction, and a gate thereof is connected to a gate line Gate which extends in a horizontal direction. One end of a retention capacitor C, the other end of which is connected to a capacitor power supply Vsc, is connected to the gate of the drive TFT 1. Such pixels are arranged in a matrix in a display area of the organic EL panel.

TFT 3 is turned on when the gate line Gate is set to a high level. At this time, when an image signal representing luminance of the pixel is applied to the data line Data, a voltage of the image signal is held in the retention capacitor C and applied to the gate of the drive TFT 1. A gate voltage of the drive TFT 1 is controlled by the image signal, and such gate voltage controls the current flowing to the organic EL elements 2. The gate voltage of the drive TFT 1 is held at a level by virtue of the retention capacitor C even after the selection TFT 3 is turned off.

An amount of emitted light of the organic EL element 2 is substantially proportional to its drive current. Therefore, the organic EL element 2 emits light according to the image signal.

An adjustment of the luminance of the organic EL panel is proposed by, for example, Japanese Patent Laid-Open Publication No. 2002-215094 (hereinafter referred to as the patent publication 1). This patent publication 1 shows that when luminance data has a prescribed level or more, the amount of current to the organic EL elements is reduced. But, it does not suggest any idea of adjusting an offset voltage.

The drive TFT 1 is turned on when the gate voltage becomes lower than the voltage of the power supply PVdd by a threshold voltage Vth or more (Vgs>Vth). Then, an offset voltage corresponding to the voltage Vth is added to an image signal to be supplied to the gate of the drive TFT 1 so that a drain current starts to flow in the vicinity of a black level of the image. The amplitude of the applied image signal is such as to provide a prescribed luminance in the vicinity of a white level. Thus, the organic EL element 2 emits light with a luminance according to the image signal.

However, the Vth of the drive TFT 1 is variable among the respective panels and also varies depending on temperature and lowers with an increase in temperature. When the Vth lowers, black in the displayed image becomes whitish to decrease contrast. Also, the luminance as a whole is increased, and current consumption increases. As a result of the increase in current consumption, there are problem such as the organic EL elements degrading quickly.

SUMMARY OF THE INVENTION

It is an object of the present invention to provide an organic EL display device which can effectively control an offset voltage to be supplied to the drive TFT. This object is achieved by an organic EL display device which individually controls the amount of current of organic EL elements, which are arranged in a matrix of pixels, according to an input image signal, comprising:

- total current detection means for detecting the total current flowing to all the organic EL elements arranged in the pixel matrix;
- offset voltage setting means for determining an offset voltage to offset the input image signal so as to apply a voltage which causes the current to start flowing to the organic EL elements according to a black level of the input image signal; and
- offset voltage control means for controlling the offset voltage, which is responsive to the offset voltage setting means, according to the total current detected by the total current detection means.

As described above, the present invention can control the offset voltage amount to an appropriate level according to the total current of the organic EL panel. Thus, an adverse effect due to an excessive quantity of current flowing to the organic EL panel can be prevented. Also, when the Vth of the organic EL driving TFT decreases due to temperature characteristics and other causes to increase the current flowing to the panel, a current increase and prominence of black can be suppressed.

When an offset adjustment voltage and an input image signal are input to the offset voltage setting means, amplification is carried out by the offset voltage setting means according to a difference between them. The offset voltage control means preferably changes the offset adjustment voltage according to the total current detected by the total current detection means.

When the detected total current has a prescribed value or lower, the total current detection means outputs a given value, and when the detected total current exceeds the prescribed value, the total current detection means outputs a value proportional to the total current. The offset voltage control means also preferably controls the offset voltage according to a value obtained by adding a predetermined black level adjustment value to the output of the total current detection means.

The present invention is directed to an organic EL display device which displays by individually controlling an amount of current of organic EL elements, which are arranged in a matrix, according to an input image signal, comprising a power supply which supplies a total current flowing to all the organic EL elements arranged in a matrix, and a low resistant value resistor which is disposed between the power supply and the organic EL elements arranged in a matrix, wherein when the total current becomes large, a voltage drop becomes large in the low resistant value resistor to suppress the current of the organic EL elements.

DESCRIPTION OF THE PREFERRED EMBODIMENTS

Figure 1:
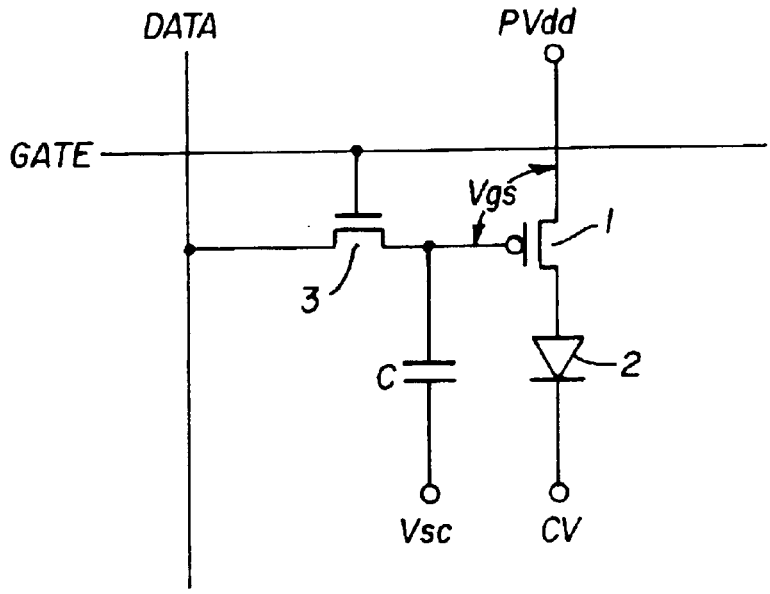
FIG. 1 (Prior Art)
FIG. 1 is a diagram showing the structure of a prior art pixel circuit.
Figure 2:
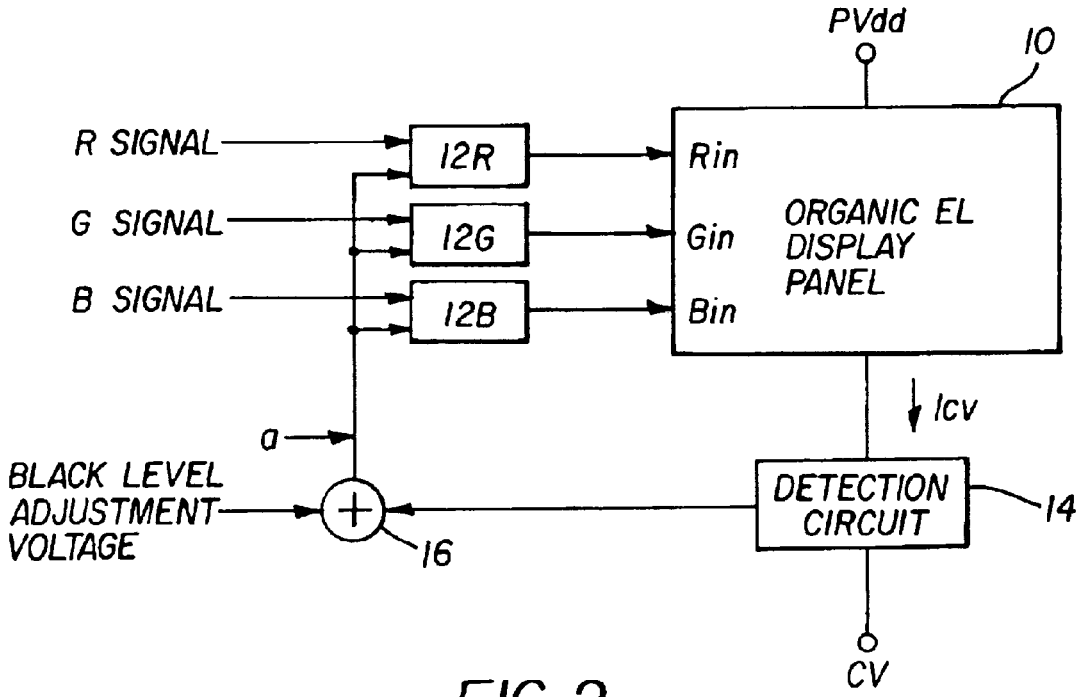
FIG. 2 is a diagram showing the structure of an embodiment of the present invention.

FIG. 2 is a block diagram schematically showing the structure of an embodiment of this invention. An organic EL display panel 10 has the pixel circuits shown in FIG. 1 arranged in a matrix in its internal display area. A perpendicular driver circuit and a horizontal driver circuit are arranged at the periphery of the display area and serve to control the application of a voltage to the data line Data and the gate line Gate.

The organic EL elements are divided for RGB (red, green, blue) respectively, and the same color pixels are arranged in a vertical direction. Specifically, a column of R, a column of G and a column of B are repeatedly arranged sequentially in the perpendicular direction, and the image signals of RGB are respectively applied to the data line Data corresponding to the columns. The organic EL elements themselves may emit light in respective colors or may emit white light, which is changed into respective colors with respective color filters.

The image signals for the respective RGB colors are separately input to the display panel 10. Input terminals for the image signals are indicated by Rin, Gin and Bin. The R signal, G signal and B signal of the input image signals are input to the input terminals Rin, Gin, Bin via black level shift circuits 12R, 12G, 12B. The display panel 10 is applied with the power supply PVdd, which is connected to the sources of the individual drive TFTs 1. Meanwhile, the cathode of the organic EL element 2 of each pixel is taken from the display panel and connected to a cathode power supply CV. Between them a CV current detection circuit 14 is disposed, in which a total current (CV current Icv) flowing to all the organic EL elements 2 of the display panel is detected. The CV current detection circuit 14 outputs 0V until the total current becomes a prescribed value and then outputs a voltage proportional to an amount of current.

The value detected by the CV current detection circuit 14 is supplied to an adder 16, which adds the detected value to a black level adjustment voltage supplied from exterior. Thus, the output of the adder 16 becomes a signal (a-point signal) which results from the addition of the output voltage value of the CV current detection circuit 14 to the black level adjustment voltage.

The a-point signal is supplied to the black level shift circuits 12R, 12G, 12B. The black level shift circuits 12R, 12G, 12B respectively shift the R signal, G signal and B signal according to the supplied a-point signal. The R signal, G signal and B signal, which have an offset amount controlled according to the total current of the organic EL display panel 10, are supplied to the organic EL display panel 10.

Accordingly, when the CV current (Icv) exceeds the prescribed value, the black level shift circuit changes the prescribed value of the black level so to make black more black. As a result, current consumption (CV current) of the organic EL display panel 10 does not exceed the predetermined value, and the prominence of black due to a change in temperature is restricted.

The black level adjustment voltage is determined to display black as prescribed black when an image of such a low current that the CV current detection circuit 14 does not operate, namely an image having a low average luminance, is displayed. Specifically, its value is determined by a prescribed inspection and stored in a system, and then read and input to the adder 16.

Figure 3:
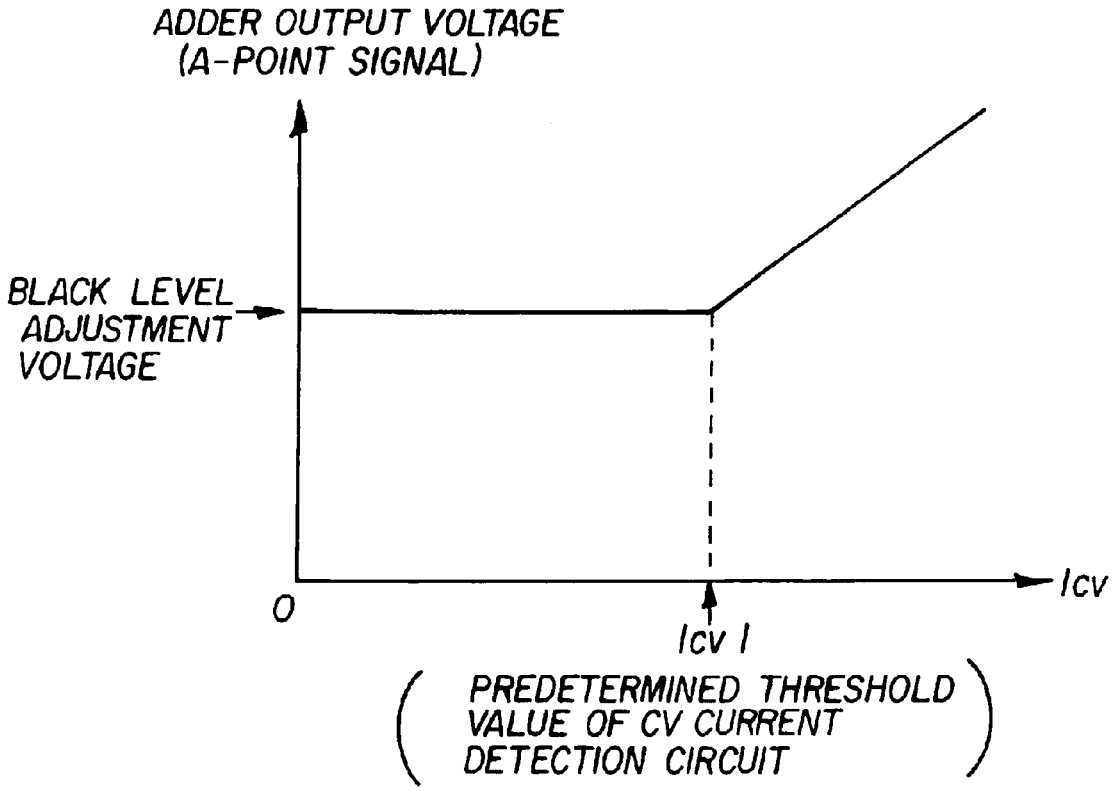
FIG. 3 is a diagram showing output characteristics of the voltage of the adder 16 versus current.

FIG. 3 is a diagram showing an example of a relationship between the CV current Icv detected by the CV current detection circuit 14 and the a-point signal being output from the adder 16. Thus, the black level adjustment voltage remains constant until the CV current becomes Icvl. When the CV current exceeds the Icvl, the a-point signal becomes large in accordance with the CV current.

Figure 4:
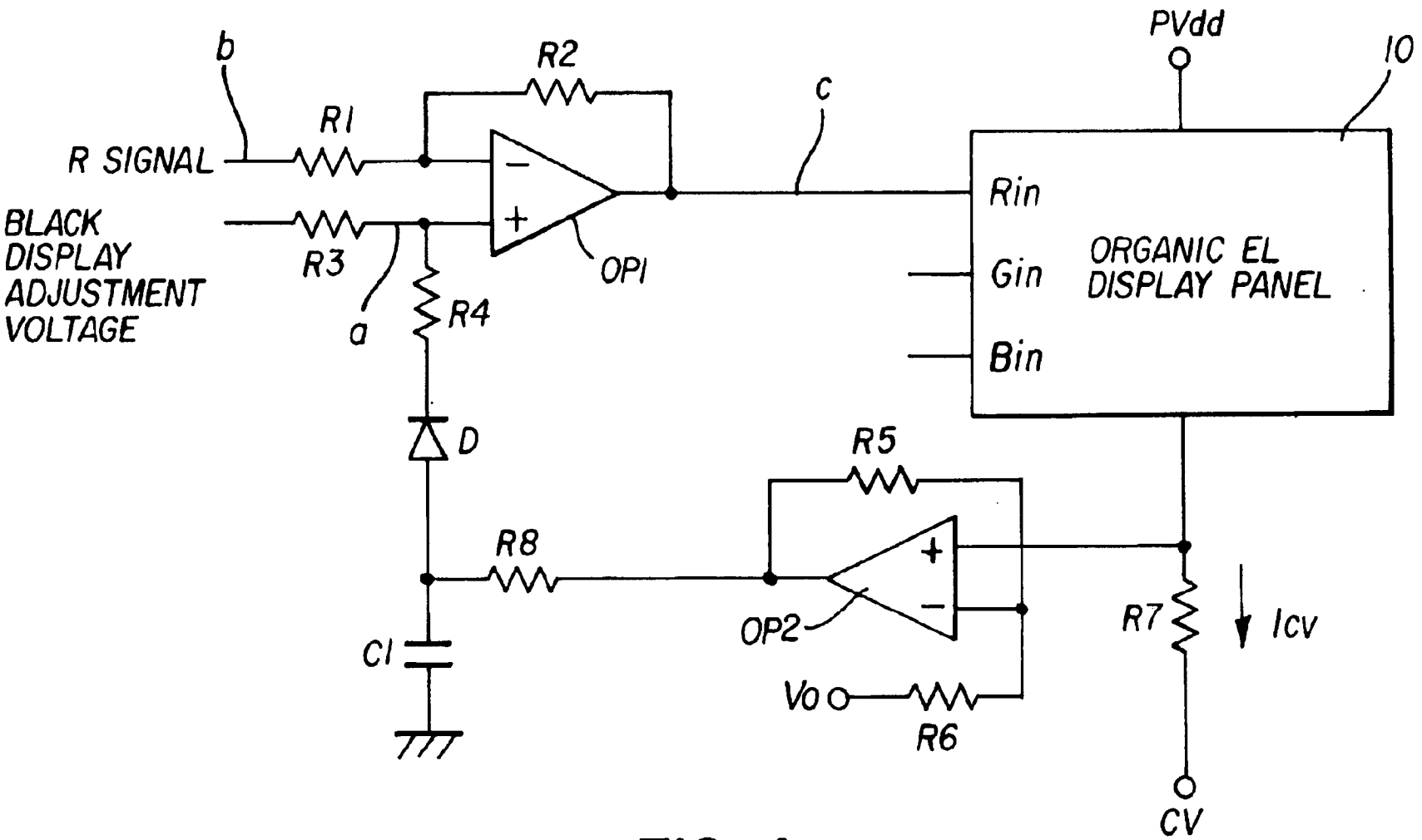
FIG. 4 is a diagram showing a specific structure of another embodiment of the invention.

As shown in FIG. 4, a resistor R7 is disposed between the organic EL display panel 10 and the cathode power supply CV. The voltage at the upper side of the resistor R7 is input to the positive input terminal of an operational amplifier OP2. A reference voltage V0 is input to the negative input terminal of the operational amplifier OP2 via a resistor R6. Besides, a feedback resistor R5 is disposed between the output terminal and negative input terminal of the operational amplifier OP2.

Output of the operational amplifier OP2 is input to the positive input terminal of the operational amplifier OP1 via a resistor R8, a diode D and a resistor R4. The black level adjustment voltage is input to the positive input terminal of the operational amplifier OP1 via a resistor R3. Therefore, the output of the operational amplifier OP2 and the black level adjustment voltage are added, and the sum is input to the positive input terminal of the operational amplifier OP1. The resistors R3, R4 are resistors for adjustment. A capacitor C1 which has another end grounded is connected to the resistor R8 and the diode D. The resistor R8 and the capacitor C1 constitute an integrator circuit, and a small time constant can be applied to the output from the OP2.

The image signal (for example, an R signal) is input to the negative input terminal of the operational amplifier OP1 via a resistor R1. A feedback resistor R2 is disposed between the output terminal and the negative input terminal of the operational amplifier OP1. Therefore, the R signal is reverse-amplified according to a ratio of the resistors R1, R2 and shifted according to the voltage input to the positive input terminal so as to be output from the operational amplifier OP1. The output is input to the Rin of the organic EL display panel 10.

Thus, a signal a is obtained at the output of the operational amplifier OP2. The resistor R7 is a resistor for detecting the CV current (Icv), and when the resistors R5 and R6 have resistance values satisfying the relationship by R5>>R6, the current detection circuit has a predetermined threshold value (Icvl) which is expressed as follows:

$$Icvl \approx (V0-CV)/R7.$$

Figure 5A:
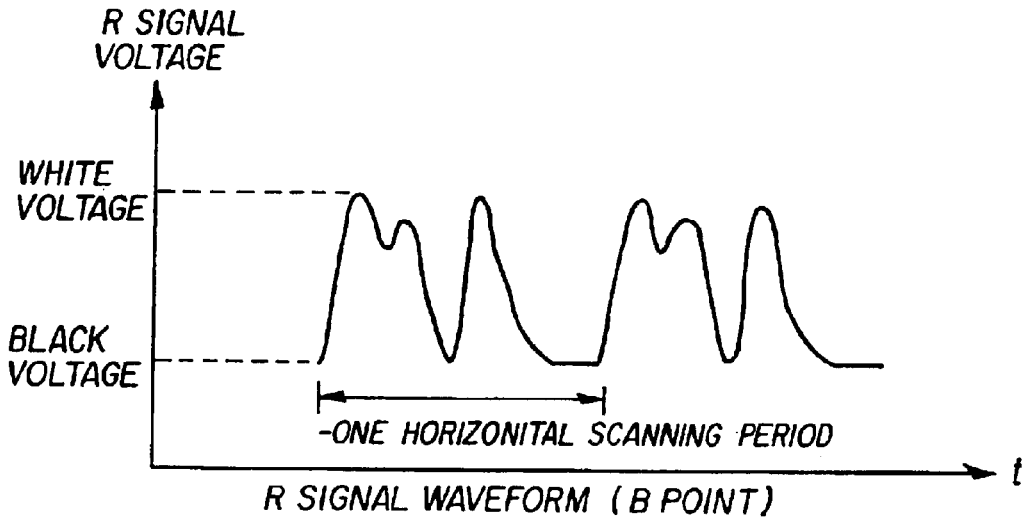
FIGS. 5*a* and 5*b* show diagrams of waveforms of an image signal at plural points, respectively.
Figure 5B:
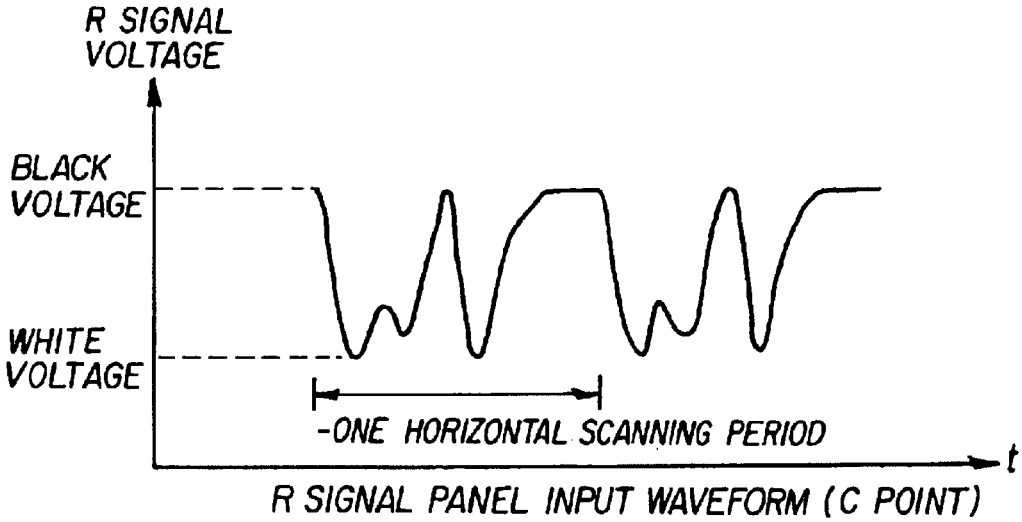

In this case, the drive TFT 1 of the organic EL panel 10 is a channel type, and the image signal shifted as described above is reversed. Therefore, the signals before and after the operational amplifier OP1 have waveforms as shown in FIG. 5. When Icv is low, the black level voltage of a point c has a prescribed value which is adjusted by the black level adjustment voltage, and when Icv exceeds Icvl, the black level voltage becomes high. Thus, because the CV current Icv becomes low, Icv is stable in the vicinity of the Icvl when R5>>R6.

As seen in FIG. 4 that only the circuit for the R signal is shown, but the same circuit is also provided for the G signal and the B signal. Specifically, the operational amplifier OP1 and the resistors R1, R2 are also disposed for the G signal and the B signal. The G signal is input to the positive input terminal of the operational amplifier OP1 for the G signal, the B signal is input to the negative input terminal of the operational amplifier OP1 for the B signal, the a-point signal is input to the respective positive input terminals, the output of the operational amplifier OP1 for the G signal is input to the Gin, and the output of the operational amplifier OP1 for the B signal is input to Bin.

As described above, this embodiment can control the offset voltage to an appropriate level according to the total current of the organic EL panel. Thus, damage to the organic EL panel due to an excessive amount of current flowing to it can be prevented. Also, when Vth of the organic EL driving TFT is lowered due to the temperature characteristics and other causes to make the current flowing to the panel exceed a prescribed value, an increase in current and prominence of black can be prevented.

Figure 6:
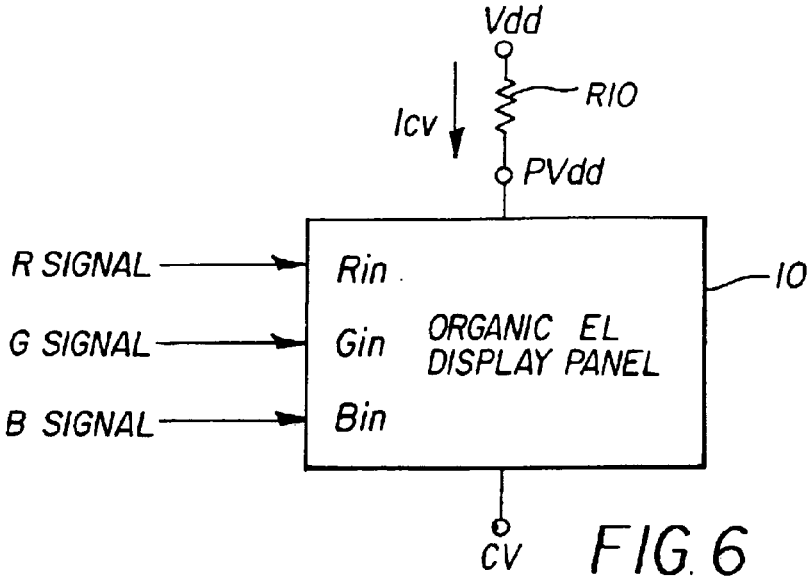
FIG. 6 is a diagram showing the structure of another embodiment of the invention.
Figure 7:
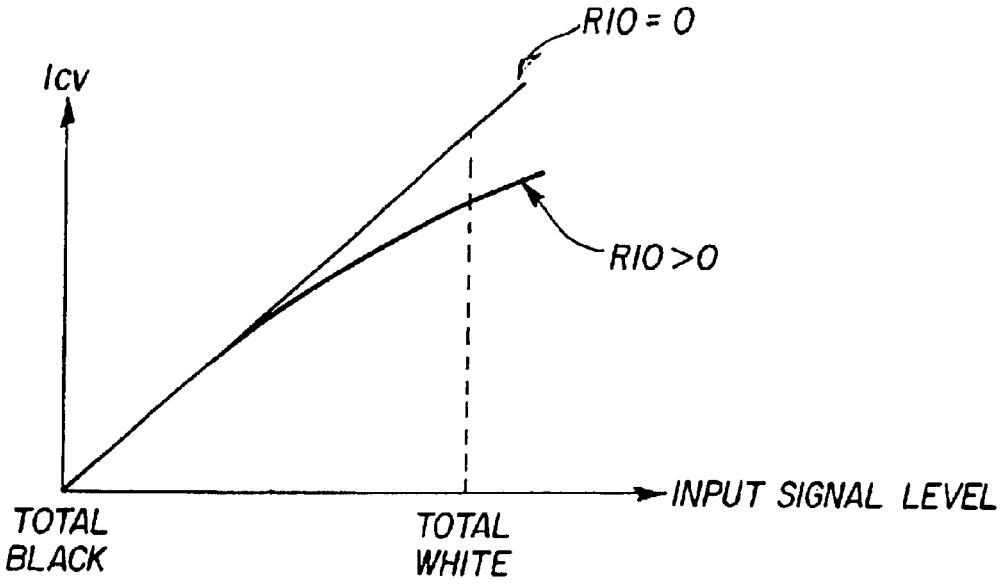
FIG. 7 is a diagram showing a relationship between the image signal and the total current for the embodiment of FIG. 6.

FIG. 6 shows another embodiment. It shows that a low resistor R10 is disposed between the power supply PVdd of the organic EL panel 10 and the power supply Vdd of the system. When Icv increases, the low resistor R10 has a large voltage drop (R10*Icv), and the power supply PVdd lowers. Because the voltage of the input image signal does not change, the voltage Vgs between the gate and source of the drive TFT 1 becomes small, and the drain current Icv lowers. As a result, the same effect, which is obtained by increasing the input black level voltage, is obtained with the increase of Icv. In this embodiment, the increase of Icv is not suppressed abruptly as in the above-described embodiment, and when the input signal level changes from total black to total white, the operation characteristics become as shown in FIG. 7. Specifically, a degree of increase in the current Icv becomes smaller as total black changes to total white.

Thus, when an amount of current becomes large in the organic EL panel 10 configured as shown in FIG. 6, the amount of current can be suppressed, and the organic EL panel can be prevented from being damaged by an excessive amount of current flowing to it. When the Vth of the organic EL driving TFT lowers due to the temperature characteristics and other causes and the current flowing to the organic EL panel exceeds the prescribed value, the increase in current and the prominence of black can be suppressed.

As described above, the offset voltage can be controlled on the basis of the total current of the organic EL panel according to the present invention, and the organic EL panel can be prevented from being damaged by an excessive amount of current flowing to it. Also, when Vth of the organic EL driving TFT lowers because of the temperature characteristics and other causes, the increase in current and prominence of black can be suppressed.

In general, while there have been described what are at present considered to be preferred embodiments of the invention, it is to be understood that various modifications may be made thereto, and it is intended that the appended claims cover all such modifications as fall within the true spirit and scope of the invention.

PARTS LIST

| | |
|---|---|
| 1 | TFT |
| 2 | EL element |
| 3 | n-channel selection |
| 10 | EL display panel |
| 12R, 12G, 12B | shift circuits |
| 14 | detection circuit |
| 16 | adder |
| C | retention capacitor |
| C1 | capacitor |
| CV | cathode power supply |
| D | diode |
| Icv | CV current |
| OP1 | operational amplifier |
| OP2 | operationsl amplifier |
| PVdd | power supply |
| RGB | image signals |
| Rin, Gin, Bin | input terminals |
| R1 | resistor |
| R2 | feedback resistor |
| R3 | resistor |
| R4 | resistor |
| R5 | feedback resistor |
| R6 | resistor |
| R7 | resistor |
| R8 | resistor |
| R10 | low resistor |
| V0 | reference voltage |
| Vsc | capacitor power supply |
| Vth | threshold voltage |

What is claimed is:

1. An organic EL display device which individually controls the amount of current of organic EL elements, which are arranged in a matrix of pixels, according to an input image signal, comprising:

total current detection means for detecting the total current flowing to all the organic EL elements arranged in the pixel matrix;

offset voltage setting means for determining an offset voltage to offset the input image signal so as to apply a voltage which causes the current to start flowing to the organic EL elements according to a black level of the input image signal; and offset voltage control means for controlling the offset voltage, which is responsive to the offset voltage setting means, according to the total current detected by the total current detection means.

2. The organic EL display device according to claim 1, wherein:

the offset voltage setting means receives an offset adjustment voltage and an input image signal and amplifies the offset adjustment voltage according; to a difference between them; and the offset voltage control means changes the offset adjustment voltage based on the total current detected by the total current detection means.

3. The organic EL display device according to claim 1 wherein:

the total current detection means outputs a prescribed value when the detected total current has a prescribed value or less and outputs a value proportional to the total current when the detected total current exceeds the prescribed value; and the offset voltage control means controls an offset voltage according to a value obtained by adding a predetermined black level adjustment value to the output of the total current detection means.

* * * * *